US005970530A

United States Patent [19]

Hansen et al.

[11] Patent Number: 5,970,530

[45] Date of Patent: Oct. 26, 1999

[54] HINGED COVER FOR A SPA TUB

[75] Inventors: Borg Hansen, Calabasas; Roc V. Fleishman, Chatsworth, both of Calif.

[73] Assignee: Softub, Inc., Chatsworth, Calif.

[21] Appl. No.: 09/069,219

[22] Filed: Apr. 28, 1998

[51] Int. Cl.[6] ..... E04H 4/00

[52] U.S. Cl. ..... 4/498; 4/503; 4/496

[58] Field of Search ..... 4/498, 496, 503, 4/499, 580

[56] References Cited

U.S. PATENT DOCUMENTS

| | | | |
|---|---|---|---|
| 3,287,740 | 11/1966 | Langer . | |
| 4,393,528 | 7/1983 | West . | |
| 4,422,192 | 12/1983 | Jacobs . | |
| 4,458,668 | 7/1984 | Sheldon . | |
| 4,606,083 | 8/1986 | Kingston . | |
| 4,857,374 | 8/1989 | Perry . | |
| 4,974,761 | 12/1990 | Luque . | |
| 5,086,525 | 2/1992 | Christopher . | |
| 5,092,951 | 3/1992 | Popovich et al. . | |
| 5,131,102 | 7/1992 | Salley et al. | 4/498 |
| 5,373,590 | 12/1994 | Svae et al. . | |
| 5,471,685 | 12/1995 | Cross | 4/580 |
| 5,619,759 | 4/1997 | Hansen et al. . | |
| 5,689,841 | 11/1997 | Black et al. | 4/498 |
| 5,802,630 | 9/1998 | Hansen et al. . | |

*Primary Examiner*—David J. Walczak

*Attorney, Agent, or Firm*—Kelly Bauersfeld Lowry & Kelley, LLP

[57] ABSTRACT

An improved insulated cover for removable mounting onto a spa or hot tub or the like, wherein the cover is hinged to accommodate folding of the cover to a compact size and shape suitable for convenient shipment and/or storage. The cover comprises a foldable base including a pair of structural membranes formed from a relatively high tensile strength fabric and sewn together on a midline to define a central hinge, and secured together at their peripheries to defined a pair of pockets within which are mounted a pair of insulation panels of relatively stiff foam or the like. In some embodiments, a foldable frame ring formed in hinged or separable half sections may be mounted to the structural membranes at the peripheries thereof. A decorative top sheet is stretched over the foldable base, and a peripheral margin thereof is wrapped over the periphery of the base and radially constricted for retention thereon by a drawstring or the like.

25 Claims, 6 Drawing Sheets

FIG. 1
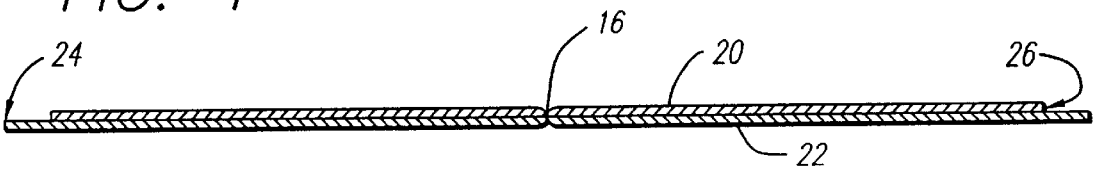
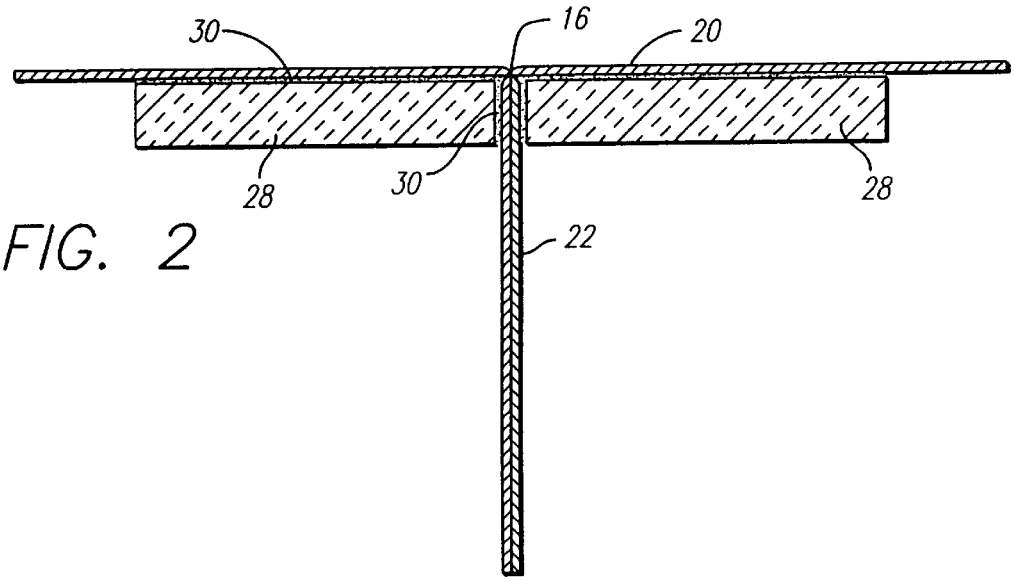
FIG. 2
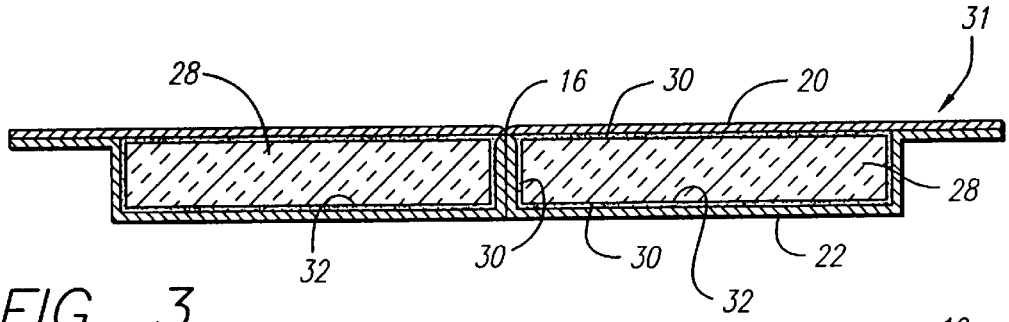
FIG. 3
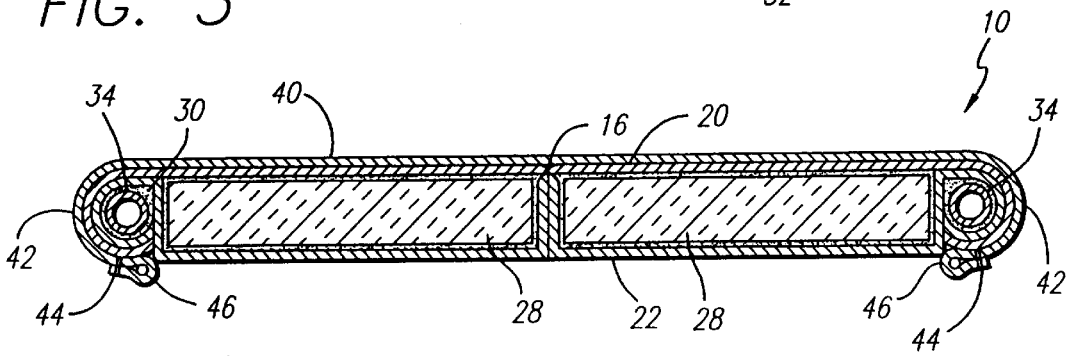
FIG. 4

FIG. 10
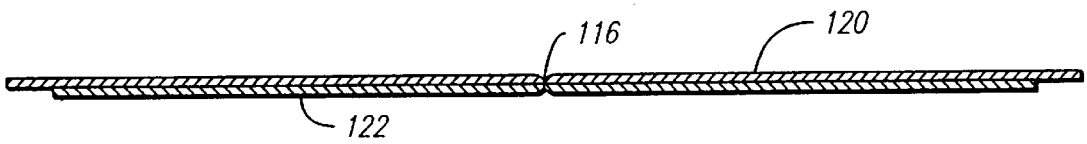
FIG. 11
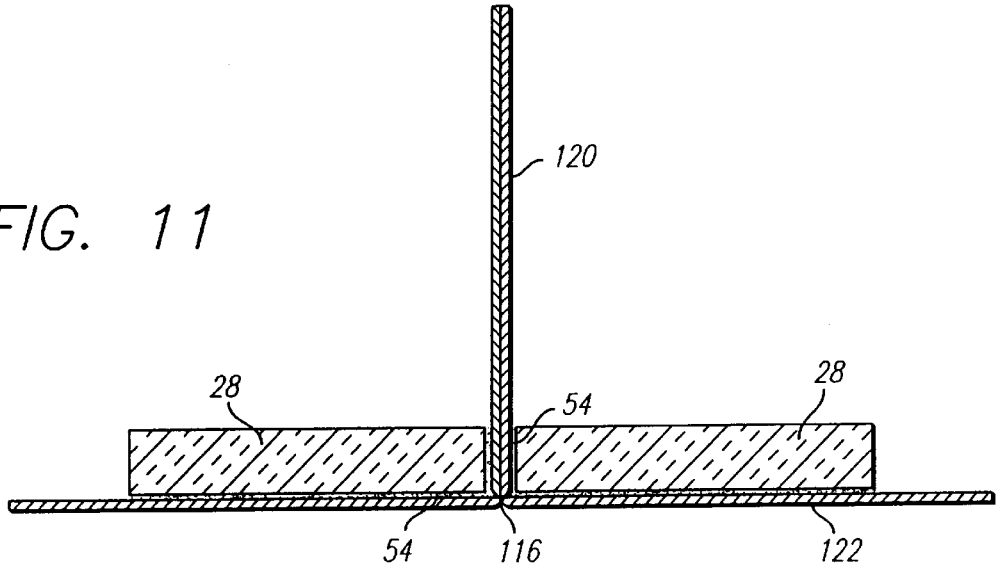
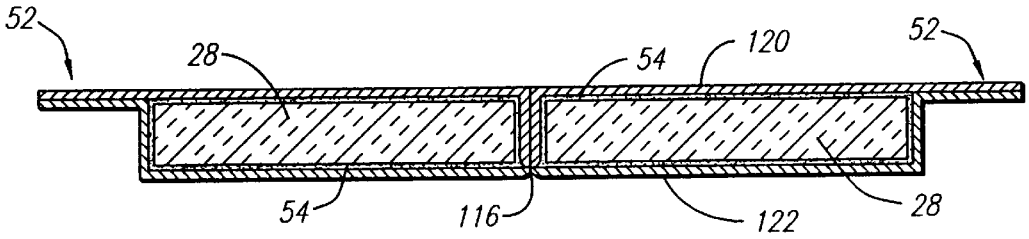
FIG. 12
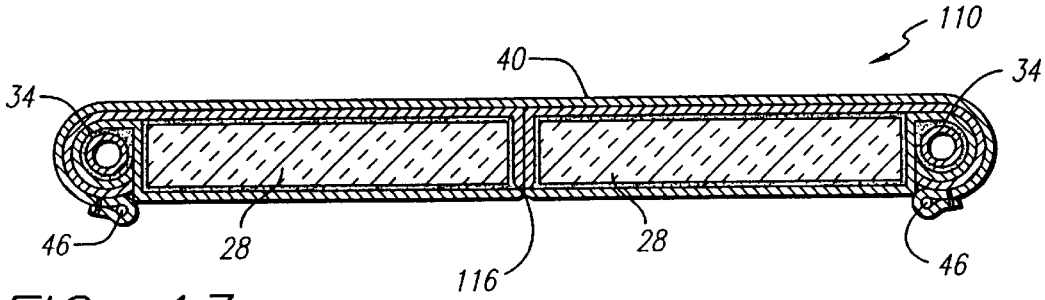
FIG. 13

FIG. 14
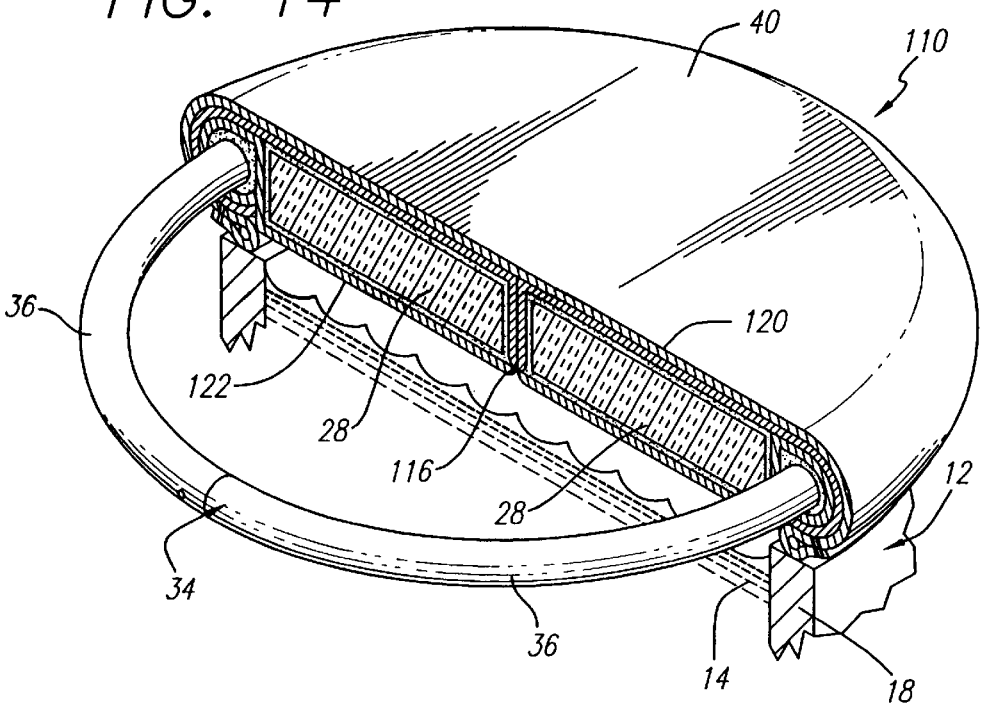
FIG. 15
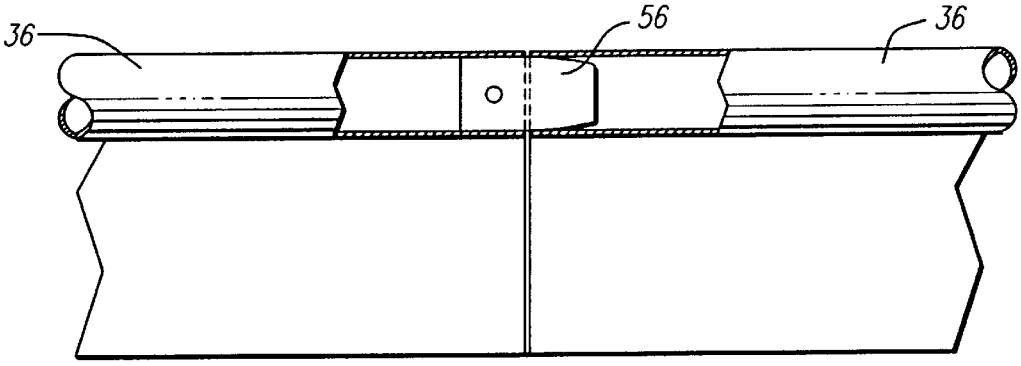
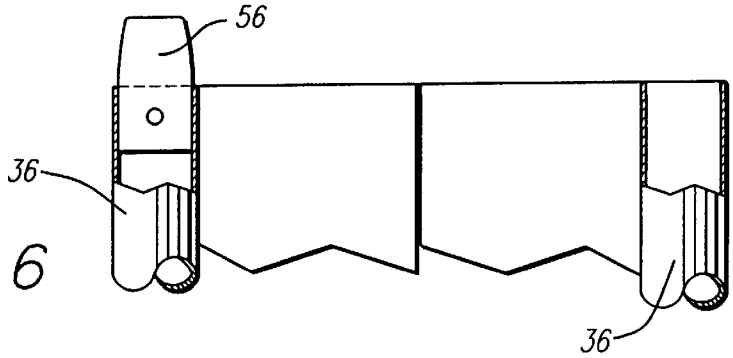
FIG. 16

FIG. 17
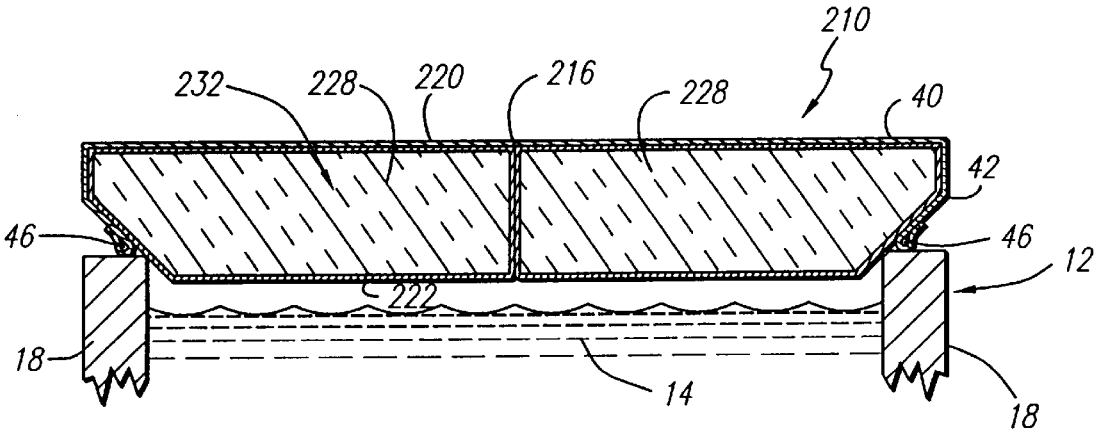
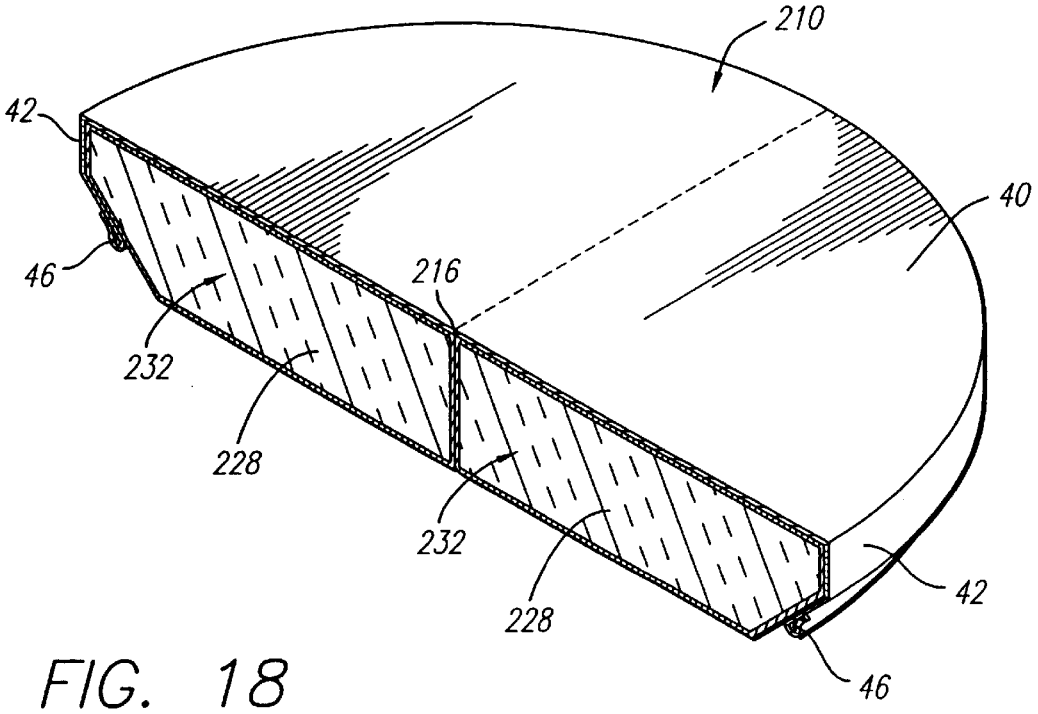
FIG. 18

HINGED COVER FOR A SPA TUB

BACKGROUND OF THE INVENTION

This invention relates generally to insulated covers or lids for mounting over a tank containing a heated fluid such as water, particularly such as a therapeutic spa tub or hot tub or the like. More specifically, this invention relates to a relatively simple, lightweight, and inexpensive insulated cover of the type shown and described in U.S. Pat. No. 5,619,759, designed for minimizing water heat and evaporative losses while additionally safeguarding against foreign objects and/or persons falling into the fluid-containing tank, but wherein the improved insulated cover is conveniently foldable to a reduce size configuration for facilitated shipping and storage.

Thermal covers for use with swimming pools and spa tubs and the like are generally known in the art. In one common form, such thermal covers comprise a flexible blanket of vinyl or other suitable plastic material to float on the water surface. The flexible blanket is designed to provide an insulative structure which is substantially impermeable to passage of water and air, whereby heat is substantially retained within the body of water and evaporative losses are substantially minimized. Alternative thermal covers which function in an analogous manner include an array of floating objects such as hollow plastic balls which substantially cover the water surface to retain heat and minimize evaporation. However, pool and spa covers of these types provide minimal protection against foreign objects falling into the pool or spa, particularly with respect to safeguarding against a child or other person falling into the water.

Other protective covers for swimming pools and spa tubs and the like have included relatively high strength blankets of canvas-backed or reinforced plastic or vinyl materials, in combination with anchor devices for retaining the blanket in a configuration stretched over the water surface. Such covers beneficially provide protection against persons and foreign objects falling into the water, but proper attachment of the cover to the requisite anchoring devices represents a time consuming and often difficult task. Moreover, the anchoring devices typically require permanent attachment to structural walls or decking surfaces surrounding the pool or spa tub.

U.S. Pat. No. 5,619,759 discloses an improved insulated cover for use with a spa tub or hot tub or the like, wherein a relatively lightweight panel of insulated foam or the like is used in combination with a structural membrane of relatively high tensile strength fabric stretched over an outer or peripheral frame ring. The structural membrane, typically in cooperation with a decorative top cover sheet, retains the insulation material in a position extending over the spa or hot tub to retain heat and prevent excess evaporation. In addition, the structural membrane provides a lightweight yet effective physical structure for withstanding substantial vertical loads, whereby the cover safeguards against persons or other objects falling into the water. Despite these benefits and advantages, however, the insulated cover described in U.S. Pat. No. 5,619,759 is not designed for convenient folding to a compact size and shape conducive to convenient shipping and/or storage.

The present invention represents a further improvement in and to insulative covers for a fluid-containing tank such as a spa tub or hot tub, particularly of the type shown and described in U.S. Pat. No. 5,619,759, wherein the cover is adapted to be folded to a convenient and compact profile for shipping and/or storage, yet wherein the cover when erected includes a high tensile strength structural membrane capable of accommodating substantial vertical loads.

SUMMARY OF THE INVENTION

In accordance with the invention, an improved insulated cover is provided for removable mounting onto a fluid-containing tank such as a spa tub or hot tub or the like. The insulated cover comprises a foldable base including at least one structural membrane assembled with a pair of insulative panels in a manner permitting hinged movement of the panels between a compact folded configuration and a substantially coplanar erected state to extend over and cover a body of water in a spa tub or the like. A decorative top sheet is assembled with the base in the erected state.

In the preferred form, the foldable base comprises a pair of structural membrane layers of substantially similar size and shape, such as a circular shape, attached together along a midline by a sewn seam or the like to define a central hinge. A pair of insulated panels of relatively stiff insulative foam or the like are fitted between the structural membranes on opposite sides of the central hinge, with the central hinge preferably lying substantially within a plane corresponding with either the top surfaces or the bottom surfaces of the insulated panels. In a common geometry, the insulated panels each have a generally semicircular shape and are positioned with their diametric edges in facing relation across the hinge. The outer peripheries of the structural membranes are then secured together as by an additional seam to define closed pockets within which the insulated panels are received. If desired, the structural membranes may be additionally attached to the insulated panels by a suitable adhesive. With this geometry, the foldable base can be folded between a compact folded state with the insulated panels overlying one on top of the other, and an erected state with the insulated panels in substantially coplanar relation.

In some forms of the invention, the foldable base may further include an outer frame ring formed by a pair of half sections secured as by an adhesive or the like to the outer peripheries of the structural membranes, with adjoining ends of the half sections disposed in interfitting relation aligned with the central hinge.

The decorative top sheet is stretched across the foldable base in the erected state, and a peripheral margin of the top sheet is wrapped over the periphery of the base and radially constricted thereon by means of a drawstring or the like. When the foldable base is oriented with the hinge substantially coplanar with a top surface of the insulated panels, the base can be returned to the folded state without removing the top sheet. In this configuration, the adjoining ends of the frame ring half sections include retention pins for capturing and retaining the drawstring in a manner retaining the top sheet on the base. Alternately, when the foldable base is oriented with the hinge substantially coplanar with the bottom surface of the insulated panels, the top sheet must be removed from the base prior to returning the base to the folded state.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a vertical sectional view illustrating a pair of structural membrane layers interconnected by a central hinge in the form of a sewn seam, for use in constructing a hinged spa cover in accordance with the invention;

FIG. 2 is a vertical sectional view showing assembly of the structural membrane layers of FIG. 1 with a pair of insulated panels;

FIG. 3 is a vertical sectional view similar to FIG. 2, and depicting further assembly of the structural membrane layers and insulated panels;

FIG. 4 is a further vertical sectional view showing a completed hinged spa cover;

FIG. 10 is a vertical sectional view similar to FIG. 1, illustrating a pair of structural membrane layers interconnected by a central hinge in the form of a sewn seam, for use in constructing a hinged spa cover in accordance with an alternative preferred form of the invention;

FIG. 11 is a vertical sectional view showing assembly of the structural membrane layers of FIG. 10 with a pair of insulated panels;

FIG. 12 is a vertical sectional view similar to FIG. 11, and depicting further assembly of the structural membrane layers and insulated panels;

FIG. 13 is a further vertical sectional view showing a completed hinged spa cover;

FIG. 14 is a perspective view, shown partially in vertical section, of the hinged spa cover constructed in accordance with the sequence of steps shown in FIGS. 10–13, with the spa cover shown in an erected state;

FIG. 15 is a fragmented plan view, shown partially in vertical section, illustrating a portion of the spa cover of FIG. 14 in the erected state;

FIG. 16 is a fragmented plan view, similar to FIG. 15, but showing the spa cover in the folded state;

FIG. 17 is a vertical sectional view depicting a further alternative preferred form of the invention; and FIG. 18 is a perspective view, shown partially in vertical section, of the hinged spa cover of FIG. 17.

DETAILED DESCRIPTION OF THE PREFERRED EMBODIMENT

Figure 5:
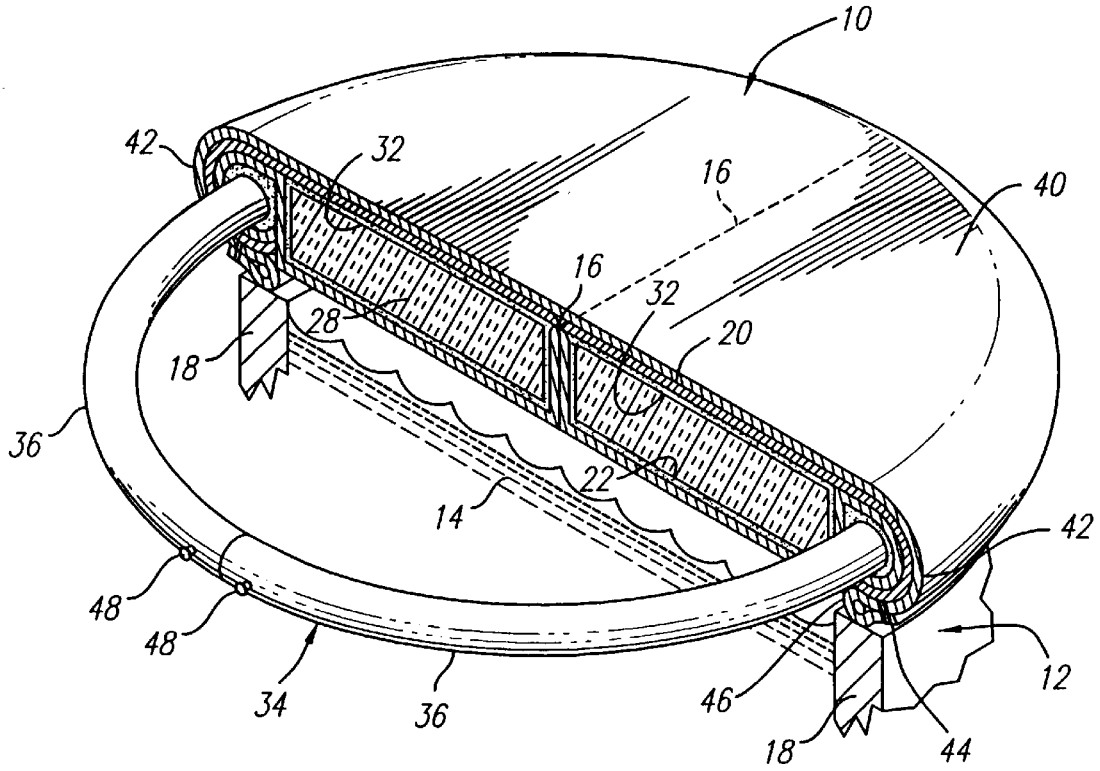
FIG. 5 is a perspective view, shown partially in vertical section, of the hinged spa cover constructed in accordance with the sequence of steps shown in FIGS. 1–4, with the spa cover shown in an erected state.

As shown in the exemplary drawings, an improved insulated cover referred to generally by the reference numeral 10 is provided for use with a fluid-containing tank such as a spa tub or hot tub 12 or the like, as shown in FIG. 5. The insulated cover 10 is designed to prevent substantial heat and evaporative loss from a body of water 14 contained within the tub 12, and also to protect against foreign objects particularly such as children and other persons from falling into the water. The cover 10 has a relatively simple, lightweight, and cost-efficient construction incorporating a central hinge 16 to facilitate compact shipping and/or storage.

The spa tub 12 shown generally in FIG. 5 has a conventional construction and operation known in the art, comprising an upwardly open tub enclosure defined by a peripheral side wall 18 for retaining the water 14 and having a sufficient size to accommodate one or more bathers. The tub 12 normally includes suitable control means (not shown) for circulating, filtering, and heating the water 14, with water delivery to the spa typically in the form of therapeutic jets. In this regard, further description of the spa tub and operation thereof may be found in U.S. Pat. No. 5,092,951, which is incorporated by reference herein.

The insulated cover 10 of the present invention is adapted for removable mounting onto the spa tub 12 when the tub is not in use. The cover 10 comprises an insulative structure which is substantially impervious to passage of water and air, whereby heat losses and evaporative losses from the water 14 can be significantly reduced during a period of non-use. In addition, the insulated cover 10 comprises a relatively lightweight and easily assembled structure having sufficient strength to safeguard against foreign objects falling into the water 14, particularly such as children and other persons. The improved cover 10 of the present invention may be folded to a more compact size and shape for convenient and economical shipping, and for convenient storage, for example, during use of the tub 12.

FIGS. 1–4 illustrate a sequence of assembly steps for the insulated and hinged spa cover 10, in accordance with one preferred form of the invention. More specifically, as shown in FIG. 1, a pair of flexible structural membranes comprising an upper layer 20 and a lower layer 22 are provided. These membrane layers 20, 22 are each formed from a relatively high tensile strength fabric for accommodating relatively high loads when assembled with other components of the insulated cover 10, as will be described, and substantially impervious to passage of water and air. Although a variety of different fabrics may be used, one preferred fabric comprises a woven and reinforced low density polyethylene coated fabric with a high density polyethylene fiber. These layers 20, 22 have a similar overall shape, such as a circular shape in the case of a spa cover for a round tub 12 as viewed in FIG. 5. As shown in FIG. 1, the lower layer 22 has a peripheral edge 24 extending slightly beyond a counterpart peripheral edge 26 of the upper layer 20. The two layers 20, 22 are joined together substantially along a midline by the central hinge 16 in the form of a sewn seam. In the case of a round spa cover 10 for a circular spa tub 12, the hinge 16 interconnects the layers 20, 22 along a common diameter.

A pair of insulated panels 28 are installed between the membrane layers 20, 22 on opposite sides of the central hinge 16. These insulated panels 28 are each formed from a relatively stiff insulative foam material, such as styrofoam, urethane, or other selected expanded open or closed cell foam material having significant insulation properties. In the case of a round spa cover, the insulated panels 28 have a generally identical semicircular shape with their diametric straight edges positioned in face-to-face opposing relation across the hinge 16. FIG. 2 shows the upper membrane layer 20 attached to a substantially coplanar top surface of the two panels 28 by a suitable adhesive 30, with the seam hinge 16 lying substantially coplanar with this top surface of the panels. The lower membrane 22 is shown secured by the adhesive to the facing straight edges of the panels 28. FIG. 3 in turn shows the balance of the lower membrane layer 22 secured by the adhesive to the substantially coplanar bottom surface of the two panels 28, and the outer peripheries of the layers 20, 22 secured to each other by additional adhesive and/or a sewn seam at a location radially outwardly from the periphery of the panels as referenced in FIG. 3 by arrow 31. In this regard, the size of the lower membrane layer 22 is chosen to be substantially coterminous with the periphery of the upper layer 20, when the layers 20, 22 are wrapped about and secured to the panels 28, as shown and described. In this configuration, the two insulated panels 28 are wrapped or contained within substantially closed pockets 32 which can be folded upwardly about the central hinge 16 to a more compact configuration.

As shown in FIGS. 4 and 5, the interconnected peripheries of the layers 20, 22 extend radially outwardly from the insulated panels 28 a sufficient distance to wrap over a frame ring 34, and may be attached thereto by additional adhesive. In the preferred form, the frame ring 34 comprises a pair of half circle sections 36 of a lightweight tubular material such as PVC tubing or the like, assembled in end-to-end relation to define a circular ring. The facing ends of the two half sections 36 are hingedly interconnected by a hinge bracket 38 (FIG. 6) which enables upward folding of the half sections into substantially overlying relation. Importantly, the frame ring 34 is arranged with the hinge brackets 38 disposed substantially in-line with the sewn seam hinge 16 between the two insulated panels, so that the two panels 28 are folded into overlying relation when the ring half sections 36 are folded. Conversely, when the ring half sections 36 are unfolded or deployed to the full circle erected state, the insulated panels 28 are similarly moved to the erected state.

The subassembly described above, comprising the insulated panels 28 carried in the pockets 32 defined by the interconnected membrane layers 20, 22, in combination with the hinged frame ring 34, represents a foldable base which can be moved between the folded and erected states as desired. In the folded state, the base is adapted for compact and convenient shipment to a customer or the like, for example, as an aftermarket item for use with a spa or hot tub. Similarly, in the folded state, the base can be stored more compactly during a period of non-use. However, the foldable base can be final-assembled quickly and easily with a decorative top cover or sheet 40.

Figure 6:
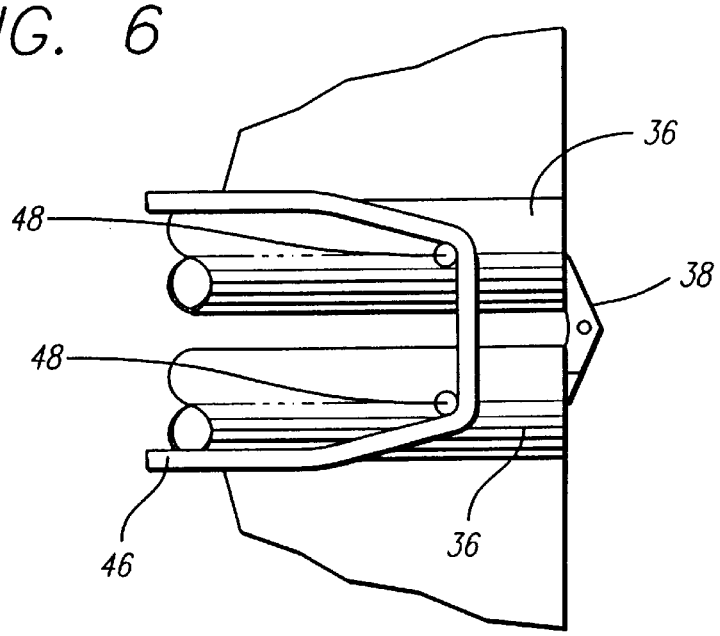
FIG. 6 is an enlarged fragmented side elevational view showing a portion of the hinged spa cover of FIG. 5 in a folded state.

The decorative top sheet 40 comprises a sheet of selected and plastic coated material or the like which is substantially impervious to passage of water and air, such as a marine grade vinyl-based material having on overall configuration similar to and adapted to fit over the foldable base. More particularly, in the preferred form, the outer peripheral margin 42 of the top sheet 40 is folded back upon itself and is seamed as at 44 to define a closed loop through which a suitable drawstring 46 is passed. The decorative top sheet 40 is stretched over the base in the erected state, as viewed in FIGS. 4 and 5, with the outer margin 42 wrapped over the perimeter of the base as defined by the frame ring 34, to extend radially inwardly a short distance beneath the frame ring. The drawstring 46 is then drawn tight and tied or fastened to retain the margin 42 of the top sheet 40 in a radially constricted position with a diametric size smaller than the frame ring 34. Retention pins 48 are conveniently provided near the ends of the ring half sections 36 to capture, guide and retain the drawstring 46 in a relatively taut condition when the fully assembled cover 10 is moved to the folded state, as shown in FIG. 6.

In use, the assembled cover 10 can be fully assembled and then moved to the folded state for compact shipment and storage. However, the cover 10 can be quickly and easily unfolded to the erected state to fit over the top of a spa tub or the like, as viewed in FIG. 4. In this position, the insulated panels 28 contained within the pockets 32 defined by the membrane layers 20, 22 span the top of the spa tub, with the periphery of the cover including the frame ring 34 seated generally on top of the tub side wall 18. The installed cover 10 provides an effective barrier to heat and evaporative losses. In addition, the cover 10 has sufficient structural integrity and strength to accommodate substantial vertical loads to substantially prevent or minimize risk of foreign objects or persons falling into the water.

Figure 7:
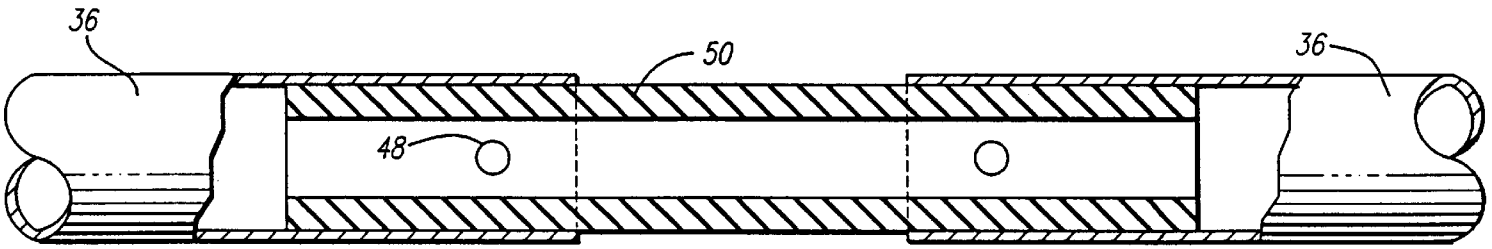
FIG. 7 is an enlarged fragmented side elevational view, shown partially in vertical section, and illustrating an alternative configuration for a portion of the hinged spa cover of FIG. 5, shown in an erected state.
Figure 9:
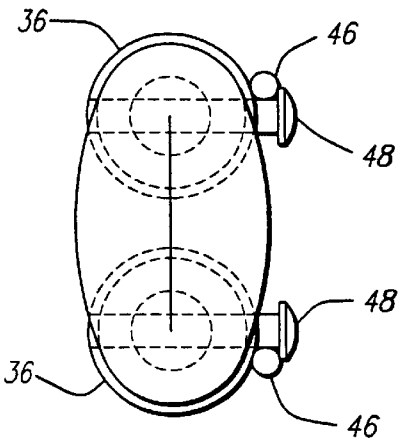
FIG. 9 is an enlarged fragmented vertical sectional view taken generally on the line 9—9 of FIG. 8.
Figure 8:
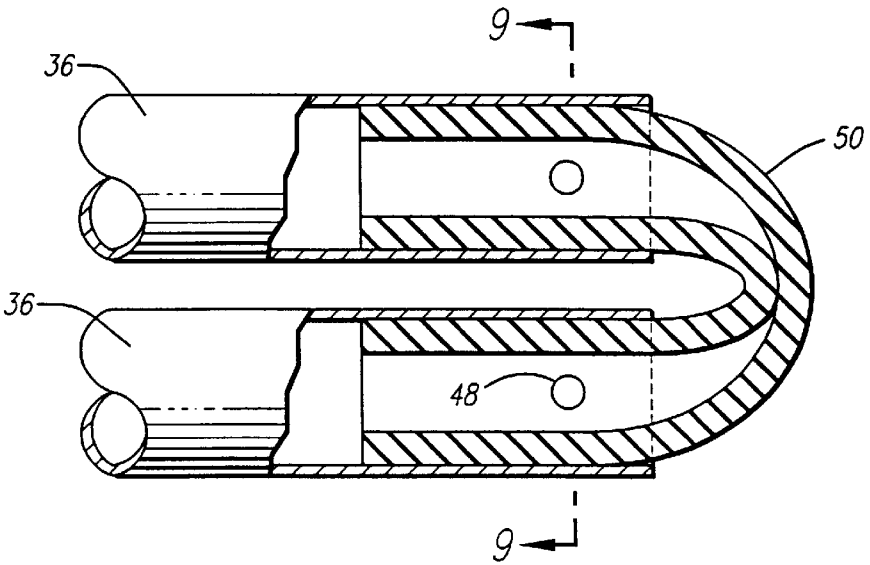
FIG. 8 is an enlarged fragmented side elevational view similar to FIG. 7, but illustrating the alternative configuration in a folded state.

FIGS. 7–9 illustrate an alternative preferred hinge bracket construction for use in the embodiment shown and described in FIGS. 1–6. More particularly, as shown, the opposing ends of the two ring half sections 36 are interconnected by a segment 50 of flexible hose or tubing, wherein the tubing segments 50 are fastened within the respective half sections 36 by means of the retention pins 48. With this construction, a simple hinge bracket construction permits easy folding of the ring half sections 36 between the folded and erected positions, while the retention pins 48 still capturing and guiding the drawstring 46 in the folded position.

FIGS. 10–16 depict a further alternative preferred form of the invention similar to the embodiments of FIGS. 1–9, but wherein the pair of insulated panels 28 are assembled between upper and lower membrane layers 120 and 122 in a manner defining a hinge 116 lying in a plane generally corresponding with a bottom surface of the panels 28. More particularly, as shown in FIG. 10, the upper and lower membrane layers 120, 122 are attached to each other generally along a midline by a sewn seam defining the hinge 116. In this embodiment, however, the outer periphery of the upper membrane layer 120 extends somewhat beyond the outer periphery of the lower membrane layer 122, in a manner generally the converse of that shown and described in FIG. 1.

FIG. 11 illustrates attachment of the lower membrane layer 122 to the bottom surface of a pair of insulated panels 28 similar to those described previously. The inboard facing edges of the panels 28 are also secured to the upper membrane layer 120 near the seam hinge 116. Thereafter, the upper layer 120 is laid over and attached to the top surface of the panels 28, followed by interconnection of the peripheries of the two layers 120, 122 as indicated by arrow 52 in FIG. 12. An adhesive 54 may be used to secure the panels 28 within pockets 32 defined between the two layers 120, 122, or the panels 28 may be loosely retained within those pockets. Moreover, the peripheries of the layers 120, 122 may be secured by additional adhesive and/or by means of a sewn seam. The peripheral margin 52 of the interconnected layers 120, 122 is then secured over a frame ring 34 formed in half sections 36 (FIGS. 13–14), as previously described, to define a foldable base which can be shipped and/or stored in a compact folded state, or moved to an erected state with the panels 28 substantially in a common plane. FIGS. 15–16 show opposing ends of the ring half sections 36, with one end having a guide member or plug 56 protruding therefrom for seated reception within the opposing end when the base is in the erected state.

A decorative cover or top sheet 40 is also provided for placement in a stretched state over the foldable base embodiment of FIGS. 10–16, wherein the top sheet 40 carries a drawstring 46 for secure mounting onto the base in the same manner as previously described. The resultant insulated cover 110 (FIGS. 13–14) may be mounted onto a spa tub or the like in the same manner to provide protection against heat and evaporative losses. In addition, the cover 110 have significant structural integrity in response to vertical loads, to protect against persons and other objects inadvertently falling into the water 14. In this embodiment, however, the mounted top sheet 40 effectively locks the cover 110 against return movement to the folded state, since the hinge 1 16 is disposed at the bottom surface or plane of the insulated panels 28. Accordingly, the top sheet 40 must be removed from the foldable base when return movement to the folded state is desired. The cover 110 can thus be shipped and stored in the compact configuration with the top sheet 40 disassembled from the foldable.

FIGS. 17–18 depict another alternative preferred form of the invention, shown similar to FIGS. 1–9, but wherein the outer frame ring 34 is omitted from the cover assembly. More specifically, in this embodiment, an insulated cover 210 is constructed from a pair of insulated panels 228 formed generally as shown and described with respect to the panels 28 in FIGS. 1–16. The panels 228 are encased within a matingly shaped pair of pockets 232 defined by upper and lower structural membrane layers 220 and 222. As shown, the membrane layers 220, 222 are interconnected at a midline by a sewn seam 216 to form a hinge disposed generally coplanar with a top surface of the two panels 228, although the hinge seam 216 could be formed generally coplanar with a lower surface of the panels 228, if desired. The resultant subassembly comprises a foldable base over which a decorative top sheet 40 is stretched and affixed by wrapping a peripheral margin 42 thereof over the periphery of the foldable base and constricting a drawstring 46, all as previously shown and described. For facilitated placement of the cover 210 over a spa tub or the like, the lower peripheral edge of the panels 228 may be beveled to rest upon an inboard edge or corner of the upstanding spa side wall 18, as viewed in FIG. 17.

The present invention thus provides a relatively simple, easily manufactured and assembled, and lightweight insulated cover for a spa tub or hot tub or the like. The cover includes a foldable base which can be moved quickly and easily between a compact folded state for convenient shipping and/or storage, and a deployed or erected state for use. When the cover is placed over a spa tub or the like, the cover substantially minimizes heat and evaporation losses and also substantially reduces the risk of a person or foreign objects falling into the spa water.

A variety of further modifications and improvements in and to the improved insulated spa cover of the present invention will be apparent to those persons skilled in the art. Accordingly, no limitation is intended by way of the foregoing description and accompanying drawings, except as set forth in the appended claims.

What is claimed is:

1. An insulated hinged cover for removable mounting onto a fluid-containing tank, said insulated cover comprising:

at least one flexible structural membrane layer;

at least two insulated panels carried by said membrane layer, said membrane layer being foldable along a hinge line separating said panels for movement of said panels between a folded position substantially overlying each other and an erected position in substantially coplanar relation, said insulated panels and said membrane layer cooperatively forming a foldable base; and a top sheet having an outer margin extending over a periphery of said foldable base and including means for radially constricting said outer margin of said top sheet to retain said top sheet on said foldable base;

said outer margin of said top sheet being folded back upon itself and seamed to define a loop, said radially constricting means comprising a drawstring passed through said loop.

2. The insulated hinged cover of claim 1 wherein said panels have a substantially coplanar top surface and a substantially coplanar bottom surface when oriented in said erected state, said hinge line being disposed generally coplanar with said top surface when said panels are oriented in said erected state.

3. The insulated hinged cover of claim 1 wherein said panels have a substantially coplanar top surface and a substantially coplanar bottom surface when oriented in said erected state, said hinge line being disposed generally coplanar with said bottom surface when said panels are oriented in said erected state.

4. An insulated hinged cover for removable mounting onto a fluid-containing tank, said insulated cover comprising:

at least one flexible structural membrane layer;

at least two insulated panels carried by said membrane layer, said membrane layer being foldable along a hinge line separating said panels for movement of said panels between a folded position substantially overlying each other and an erected position in substantially coplanar relation, said insulated panels and said membrane layer cooperatively forming a foldable base; and a top sheet having an outer margin extending over a periphery of said foldable base and including means for radially constricting said outer margin of said top sheet to retain said top sheet on said foldable base;

said panels being carried in a pair of pockets formed by said at least one structural membrane.

5. The insulated hinged cover of claim 4 wherein said panels have a substantially coplanar top surface and a substantially coplanar bottom surface when oriented in said erected state, said hinge line being disposed generally coplanar with said top surface when said panels are oriented in said erected state.

6. The insulated hinged cover of claim 4 wherein said panels have a substantially coplanar top surface and a substantially coplanar bottom surface when oriented in said erected state, said hinge line being disposed generally coplanar with said bottom surface when said panels are oriented in said erected state.

7. An insulated hinged cover for removable mounting onto a fluid-containing tank, said insulated cover comprising:

at least one flexible structural membrane layer;

at least two insulated panels carried by said membrane layer, said membrane layer being foldable along a hinge line separating said panels for movement of said panels between a folded position substantially overlying each other and an erected position in substantially coplanar relation, said insulated panels and said membrane layer cooperatively forming a foldable base; and a top sheet having an outer margin extending over a periphery of said foldable base and including means for radially constricting said outer margin of said top sheet to retain said top sheet on said foldable base;

said panels being connected to said at least one structural membrane by an adhesive.

8. An insulated hinged cover for removable mounting onto a fluid-containing tank, said insulated cover comprising:

at least one flexible structural membrane layer;

at least two insulated panels carried by said membrane layer, said membrane layer being foldable along a hinge line separating said panels for movement of said panels between a folded position substantially overlying each other and an erected position in substantially coplanar relation, said insulated panels and said membrane layer cooperatively forming a foldable base;

a top sheet having an outer margin extending over a periphery of said foldable base and including means for radially constricting said outer margin of said top sheet to retain said top sheet on said foldable base; and a frame ring formed from a pair of ring half sections, said frame ring being carried by said structural membrane layer with said ring half sections in end-to-end relation, and with the adjoining ends of said half sections aligned generally with said hinge line.

9. The insulated hinged cover of claim 8 wherein said radially constricting means comprises a drawstring, and further wherein said ring half sections include means for capturing and retaining said drawstring in a relatively taut condition upon movement of said panels to said folded state.

10. The insulated hinged cover of claim 8 further including a pair of hinge brackets for pivotally interconnecting said ring half sections in end-to-end relation.

11. The insulated hinged cover of claim 10 wherein said hinge brackets each comprise a length of flexible tubing.

12. An insulated hinged cover for removable mounting onto a fluid-containing tank, said insulated cover comprising:

at least one flexible structural membrane layer;

at least two insulated panels carried by said membrane layer, said membrane layer being foldable along a hinge line separating said panels for movement of said panels between a folded position substantially overlying each other and an erected position in substantially coplanar relation, said insulated panels and said membrane layer cooperatively forming a foldable base; and a top sheet having an outer margin extending over a periphery of said foldable base and including means for radially constricting said outer margin of said top sheet to retain said top sheet on said foldable base;

said at least one structural membrane layer comprising an upper membrane layer and a lower membrane layer, a hinge seam interconnecting said upper and lower membrane layers generally along a common midline to define said hinge line, and said upper and lower membrane layers being interconnected generally at the peripheries thereof to define a pair of pockets for respective reception of said panels.

13. The insulated hinged cover of claim 12 wherein said hinge seam is disposed generally coplanar with a top surface of said panels when oriented in said erected state.

14. The insulated hinged cover of claim 12 wherein said hinge seam is disposed generally coplanar with a bottom surface of said panels when oriented in said erected state.

15. The insulated hinged cover of claim 1 wherein said top sheet comprises a flexible material substantially impervious to passage of air and water.

16. The insulated hinged cover of claim 1 wherein said structural membrane layer comprises a flexible material substantially impervious to passage of air and water.

17. An insulated hinged cover for removable mounting onto a fluid-containing tank, said insulated cover comprising:

a foldable base including upper and lower flexible structural membrane layers interconnected by a hinge seam substantially along a midline, means for interconnecting the outer peripheries of said upper and lower membrane layers to define a pair of pockets disposed on opposite sides of said hinge seam, and a pair of insulated panels received within said pockets, said panels being movable between a folded state generally overlying each other and an erected state in substantially coplanar relation; and a top sheet having an outer margin extending over a periphery of said foldable base and including means for radially constricting said outer margin of said top sheet to retain said top sheet on said foldable base.

18. The insulated hinged cover of claim 17 wherein said outer margin of said top sheet is folded back upon itself and is seamed to define a loop, and further wherein said radially constricting means comprises a drawstring passed through said loop.

19. The insulated hinged cover of claim 17 wherein said panels have a substantially coplanar top surface and a substantially coplanar bottom surface when oriented in said erected state, said hinge seam being disposed generally coplanar with said top surface when said panels are oriented in said erected state.

20. The insulated hinged cover of claim 17 wherein said panels have a substantially coplanar top surface and a substantially coplanar bottom surface when oriented in said erected state, said hinge seam being disposed generally coplanar with said bottom surface when said panels are oriented in said erected state.

21. The insulated hinged cover of claim 17 wherein said panels are connected to said membrane layers by an adhesive.

22. The insulated hinged cover of claim 17 further including a frame ring formed from a pair of ring half sections, said frame ring being carried by said structural membrane layers with said ring half sections in end-to-end relation, and with the adjoining ends of said half sections aligned generally with said hinge seam.

23. The insulated hinged cover of claim 22 wherein said radially constricting means comprises a drawstring, and further wherein said ring half sections include means for capturing and retaining said drawstring in a relatively taut condition upon movement of said panels to said folded state.

24. The insulated hinged cover of claim 22 further including a pair of hinge brackets for pivotally interconnecting said ring half sections in end-to-end relation.

25. The insulated hinged cover of claim 24 wherein said hinge brackets each comprise a length of flexible tubing.

* * * * *